United States Patent [19]

Huitema et al.

[11] Patent Number: 4,548,094

[45] Date of Patent: Oct. 22, 1985

[54] HANDLE CONTROL ASSEMBLY

[75] Inventors: Thomas W. Huitema; David A. DeSutter, both of Racine, Wis.

[73] Assignee: J. I. Case Company, Racine, Wis.

[21] Appl. No.: 471,590

[22] Filed: Mar. 3, 1983

[51] Int. Cl.[4] ..... G05G 5/04

[52] U.S. Cl. ..... 74/526; 74/475; 74/532

[58] Field of Search ..... 74/526, 475, 477, 566, 74/532; 70/192, 193, 247; 180/322, 315, 336; 172/7, 8, 9, 10, 11, 12

[56] References Cited

U.S. PATENT DOCUMENTS

| | | | |
|---|---|---|---|
| 1,344,602 | 6/1920 | Warner | 74/526 |
| 1,448,105 | 3/1923 | Bell | 74/532 |
| 2,025,253 | 12/1935 | Still | 74/475 |
| 2,618,167 | 11/1952 | Seifert | 172/7 X |
| 2,826,093 | 3/1958 | Draper | 74/531 X |
| 2,900,836 | 8/1959 | Gleeson et al. | 74/526 X |
| 3,199,368 | 8/1965 | Funk et al. | 74/526 |
| 3,550,715 | 12/1970 | Johnson | 180/315 |
| 3,626,780 | 12/1971 | Lowder et al. | 74/526 |
| 4,077,276 | 3/1978 | Knox | 74/475 |
| 4,116,086 | 9/1978 | Langford et al. | 74/532 |
| 4,297,914 | 11/1981 | Klem et al. | 74/532 |

FOREIGN PATENT DOCUMENTS

| | | | |
|---|---|---|---|
| 55-102735 | 8/1980 | Japan | 74/526 |
| 502189 | 3/1939 | United Kingdom | 74/532 |

*Primary Examiner*—Kenneth J. Dormer
*Assistant Examiner*—Rodney M. Lindsey
*Attorney, Agent, or Firm*—Dressler, Goldsmith, Shore, Sutker & Milnamow, Ltd.

[57] ABSTRACT

An arrangement for controlling the range of movement of a linearly movable control handle is disclosed which is particularly suited for embodiment in association with a control console through which the control handle extends. The arrangement includes a handle guide adapted to be mounted on and beneath the control console cover for limited rotational movement. This rotational movement allows the guide to be selectively positioned to control the range of linear movement of the control handle. In a first position of the guide, the control handle is retained against linear movement in a neutral position. In a second position of the guide, the control handle is operable through a range of limited linear movement, while in a third position of the guide the control handle is operable through a range of relatively greater linear movement. The handle movement control arrangement also includes a detent mechanism operatively associated with the guide and console cover for releasably maintaining the guide in any selected one of the three positions. Stop tabs are also included to limit the degree of rotational movement of the guide.

9 Claims, 9 Drawing Figures

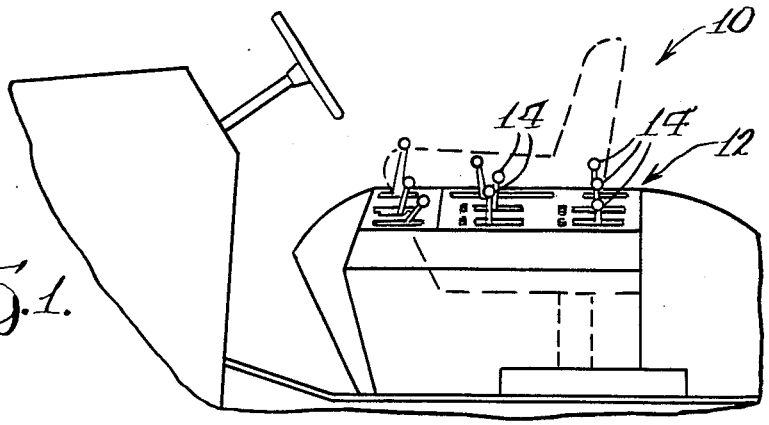
Fig. 1.
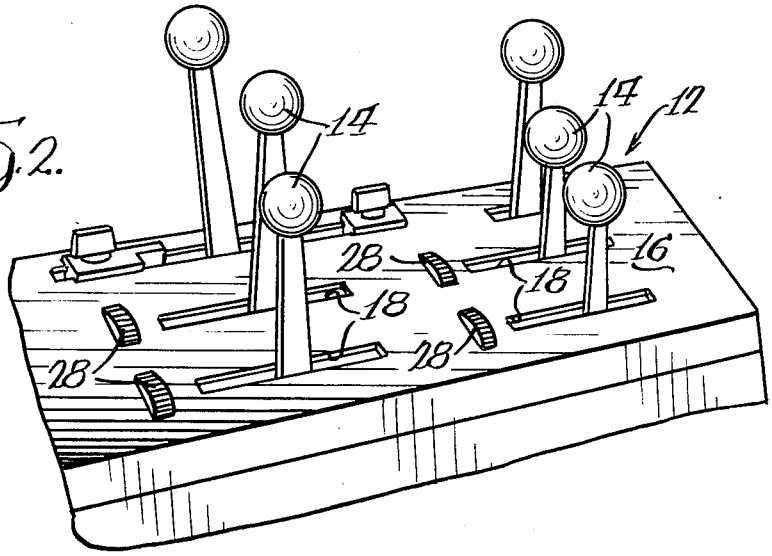
Fig. 2.
Fig. 3.
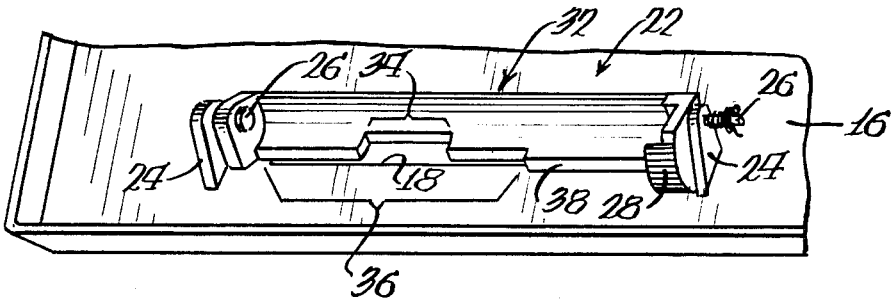

Fig. 4.
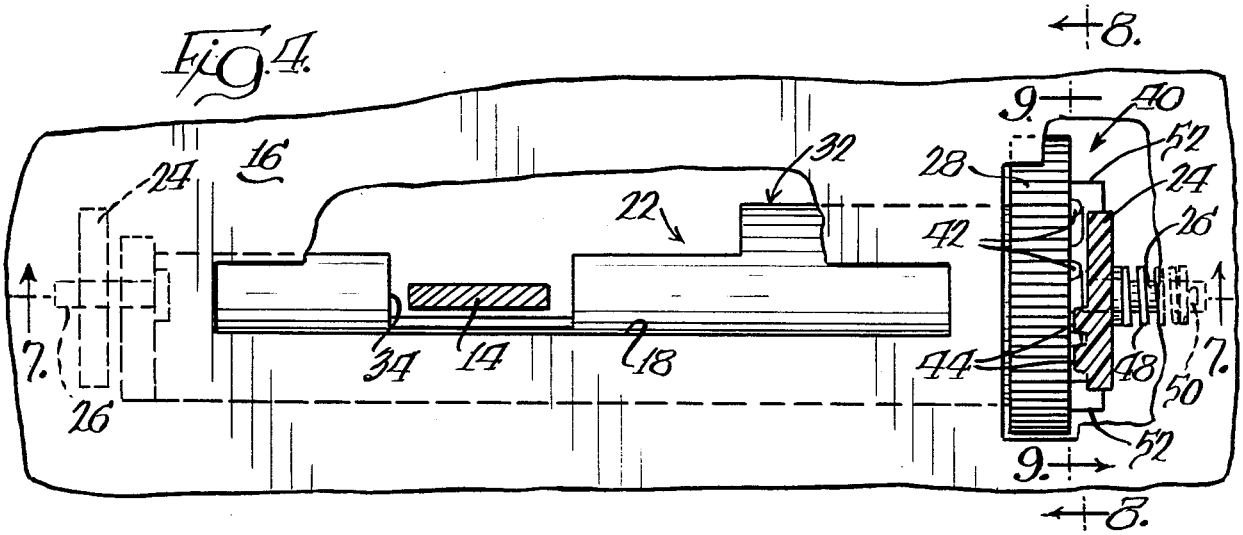
Fig. 5.
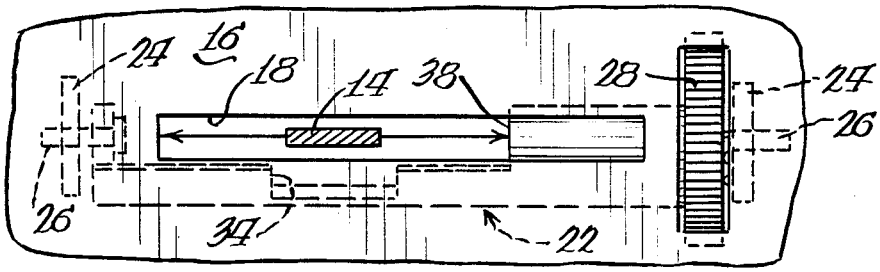
Fig. 6.
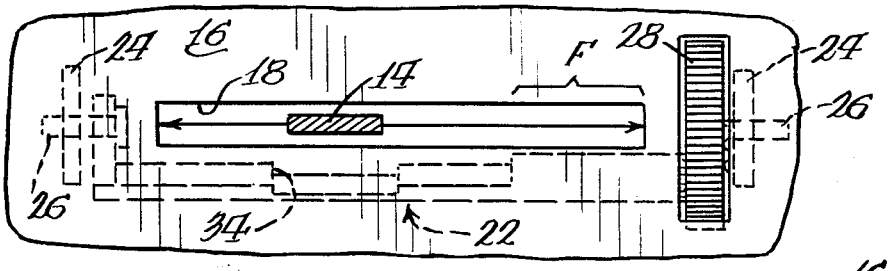
Fig. 7.
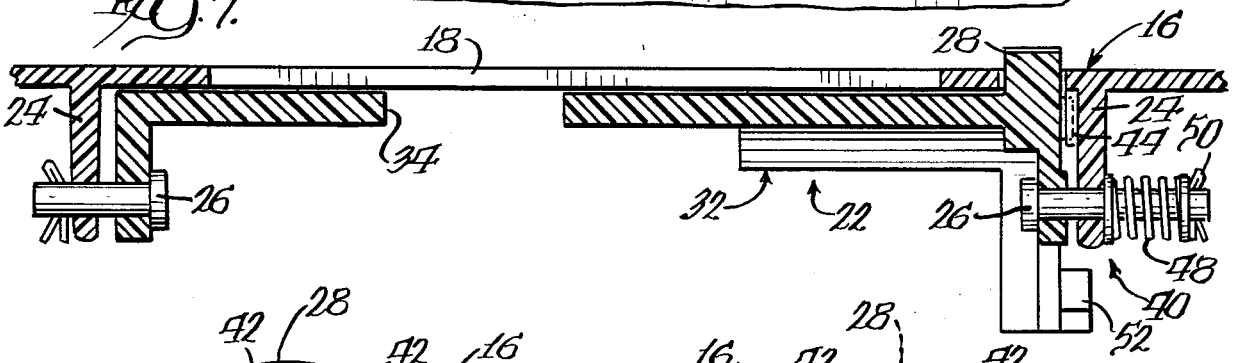
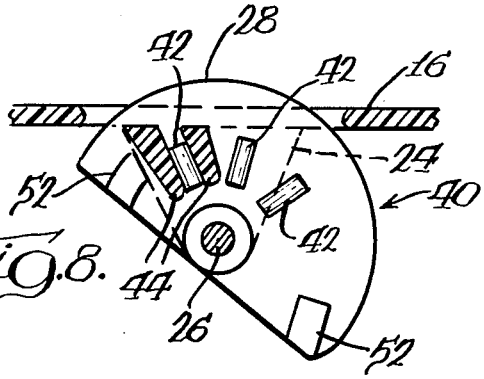
Fig. 8.
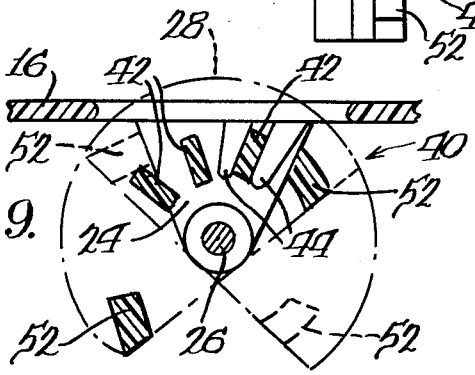
Fig. 9.

HANDLE CONTROL ASSEMBLY

FIELD OF THE INVENTION

This invention relates generally to control handle assemblies, and more particularly an arrangement for selectively controlling linear movement of a control handle such as in material handling equipment.

BACKGROUND OF THE INVENTION

To meet the demands for efficient operation of present day material handling equipment, constant redesigning and alteration of such equipment has occured over the years for increased versatility, automation and ease of use. One such improvement concerns positioning of a plurality of control handles in a unitary control console. This console is typically positioned adjacent the operator of the device in the operator's cab for efficient manipulation of the controls. Such a unitary grouping of control handles typically includes a number of control handles for operating remote hydraulic actuators associated with various implements on the material handling device, such as a backhoe, front end loader, an equipment hitch and the like.

While the above-described unitary control console facilitates efficient and convenient use of the control handles for operating the material handling device, in certain instances efficient operation can be enhanced by permitting the operator to selectively lock one or more of the control handles, or to limit their movement to a predetermined range. Such control or selective limitation of the range or path of movement of the control handles allows the handles to be locked in a non-use or neutral position, thereby effectively precluding inadvertent movement of the control handles by the operator. In addition, such selective limitation of the range of movement of the control handles limits the path that can be traversed by the control handles to effectivelv obviate inadvertant positioning of the control handles in an undesired position.

Therefore, it would be beneficial to provide an arrangement for selectively controlling the range of movement of a control handle extending through a console cover. Use of such a device would allow for enhanced efficiency in operation of a material handlinq implement by permitting the operator to "set up" or "pre-set" the implement controls according to the type of work operation to be performed. Enhanced efficiency in the control of material handling equipment provides savings in the cost of performing work operations by minimizing the time required to perform the work. Convenient operation of controls also minimizes operator fatigue, which in turn further facilitates efficient material handling.

SUMMARY OF THE INVENTION

The handle control arrangement embodying the present invention provides improved efficiency in the operation of implements such as material handling equipment. Such improved operation is provided by an arrangement for selectively controlling or defining the range of linear movement of a control handle associated with a control console, the control handle extending through a slot of finite length defined by the cover of the control console.

The present control arrangement allows the control handle to be selectively locked in a given position, such as a neutral position, to effectively prevent the operator from inadvertently moving the control handle. This locking facilitates efficient operation since the operator need not be concerned with inadvertently actuating a control which is not to be used during a particular job, or which is associated with an implement of the material handling device which is to be kept in a fixed condition during the work operation. In other alternate positions of the present handle control, the range of movement of the control handle may be selectively altered, thus further facilitating control by the operator of the handle's function.

In the illustrated embodiment of the present invention, selective control is provided of the linear movement of a control handle which extends through a slot defined by a control console cover. The control arrangement includes a unique handle guide adapted for rotational mounting on and beneath the console cover adjacent the slot through which the control handle extends. The guide preferably includes an elongated center portion extending between and connecting two end portions of the guide, the end portions supporting the guide for limited rotational movement beneath the console cover. The guide also preferably includes a thumb wheel adjustment which protrudes through the console cover for allowing selective positioning of the guide into one of a plurality of positions. In this manner, the range of travel through which the control handle is movable may be easily selected.

The center portion of the guide is configured so that it defines a first opening within which the control handle may be positioned when the guide is rotated to a first position by the thumb wheel. With the guide in this first position, the control handle is retained against linear movement and is effectively locked, such as in a neutral position.

The center portion of the guide also defines a second opening within which the control handle is movable when the guide is moved to a second position by movement of the thumb wheel adjustment. The second opening preferably forms a path for relatively limited linear movement of the control handle. When the guide is in its second position, the control handle is movable through only a portion of its entire throw or path of travel. Thus, limited movement of the handle by the operator is permitted, but inadvertant movement of the handle to an undesired position is avoided.

The handle guide is also movable to a third position, selectable by the thumb wheel adjustment, which allows the control handle to be operated through a relatively greater range of linear movement than that defined by the second opening. In the illustrated embodiment, this path of extended linear movement is defined by the slot formed in the control console cover, and corresponds to the full range of available movement of the control handle.

The handle movement control arrangement also preferably includes a simple yet effective detent mechanism associated with the handle guide and the console cover for releasably maintaining the guide in any one of its selected positions. The detent mechanism preferably includes a plurality of projections on the thumb wheel end portion of the guide which are adapted to cooperate with the control console cover for selectable positioning of the guide. The detent mechanism also preferably includes a biasing spring for urging at least one of the projections into cooperative association with the console cover, with the handle guide preferably mounted for limited movement axially of its rotational axis in opposition to the biasing spring to provide the desired detent action.

The thumb wheel end portion of the handle guide preferably further includes stop tabs which project from the thumb wheel of the guide for cooperative engagement with the console cover. These stop tabs limit the rotational movement of the guide and prevent the guide from being moved past the first selectable position on one end of rotational travel of the guide, and past the third selectable position on the other end of rotational movement of the guide. Convenient positioning of the guide by the operator is thereby facilitated.

Numerous other advantages and features of the present invention will become readily apparent from the following detailed description of the invention and embodiment thereof, from the claims, and from the accompanying drawings in which like numerals are employed to designate like parts throughout the same.

BRIEF DESCRIPTION OF THE DRAWINGS

FIG. 1 is a side elevational view of a tractor cab with a unitary control console having handle control arrangement embodying the present invention;

FIG. 2 is an enlarged, perspective view of the control console illustrated in FIG. 1;

FIG. 3 is a fragmentary perspective view of the underside of the control console of FIG. 2 illustrating the handle guide of the present invention;

FIG. 4 is a top plan view in partial cutaway of a portion of the control console of FIG. 2 further illustrating the present handle control arrangement;

FIGS. 5 and 6 are views similar to FIG. 4 illustrating the selective positioning of the present handle control arrangement;

FIG. 7 is a cross-sectional view taken along lines 7—7 of FIG. 4;

FIG. 8 is a cross-sectional view taken generally along lines 8—8 of FIG. 4 illustrating the detent mechanism and stop means of the present invention; and FIG. 9 is a cross-sectional view taken generally along lines 9—9 of FIG. 4 further illustrating the detent mechanism and stop means of the present invention.

DESCRIPTION OF THE PREFERRED EMBODIMENT

While this invention is susceptible of embodiment in many different forms, there is shown in the drawings and will herein be described in detail a presently preferred embodiment, with the understanding that the present disclosure is to be considered as an exemplification of the principles of the invention and is not intended to limit the invention to the embodiment illustrated. It is to be understood that variations may be made by one skilled in the art without departing from the true spirit and scope of the invention.

Upon inspection of FIG. 1, it will be seen that a tractor cab 10 having a unitary control console 12 is therein illustrated. The control console 12 includes a plurality of control handles 14 such as for operating remote hydraulic actuators associated with various implements on the tractor. While the present invention as described herein is shown in conjunction with control console 12 of tractor cab 10 since the invention is particularly suited for use in material handling equipment, it will be understood by those skilled in the art that the handle control arrangement of the present invention is equally suitable for use in other control console installations.

As will be appreciated, control handles 14 are typically each movable in a lever-like fashion through a linear path. However, it should be understood that the present invention is suited for use in association with other types of controls exhibiting generally linear control handle movement.

FIG. 2 illustrates a control console cover 16 of control console 12, which includes elongated slots 18 through which the control handles 14 respectively extend. It will be noted that other control handles, in addition to control handles 14, also typically extend through slots defined by the control console cover 16. As disclosed herein, the present handle movement control arrangement is preferably provided for each of handles 14, although provision of the control arrangement is a matter of design choice depending upon the specific application involved.

Control handles 14 typically comprise a grouping of handles which control remote hydraulic actuators associated with various implements on the material handling device. These implements may include backhoes, front end loaders, trailor hitches and the like. Such implements have specific control functions which require manipulation of control handles 14 for control and positioning of the implements. In view of this, control handles 14 are typically movable from a generally centrally located neutral position in first and second opposite directions for selective control of the associated implements. In some applications, one or more of the control handles 14 may include a "neutral return" feature which provides return of the control handle to its predetermined neutral position when no pressure is applied to the handle by an operator.

In the usual application, control handles 14 are movable in the first and second opposite directions from the neutral position for respectively extending and retracting a hydraulic actuator, including a cylinder and piston, of an associated implement. Notably, handles 14 in the illustrated embodiment of the invention are movable in the first direction to one end of the predetermined path defined by elongated slot 18 to allow the implement actuator associated with that control handle 14 to be in a "float" mode. The "float" mode allows hydraulic fluid to freely move in and out of the hydraulic actuator associated with that implement in response to any external pressure that is applied to the implement. For example, such a "float" mode is typically required when operating plows and like hitch-mounted implements for grooming or otherwise working uneven terrain. In such an application, the "float" mode allows the plow to move up or down as necessary to follow the contour of the terrain. In contrast, positioning of one of the handles 14 in its neutral position typically locks the associated hydraulic actuator in a fixed condition. While the present handle movement control arrangement is particularly suited for use with control handles movable to such a "float" position, it is equally suited for other applications as well.

Turning now to FIG. 3, a handle guide 22 of the present invention is therein illustrated. It will be noted that FIG. 3 illustrates a portion of the underside of console cover 16, and shows one of the slots 18 through which one of the control handles 14 (not shown) in FIG. 3 extends. Handle guide 22 is preferably rotatably mounted on and beneath control console cover 16 on mounting brackets 24 by mounting pins 26 which extend through opposite end portions of the guide. The handle guide 22 is preferably rotatable about an axis extending generally parallel to the direction of linear movement of the control handle 14 which extends through slot 18. The handle guide 22 preferably includes a thumb wheel 28 for selective rotational positioning of the guide 22. As can be seen in FIGS. 2 and 7, the thumb wheel 28 is accessible to the operator through a thumb wheel cutout in control console cover 16. This allows the handle guide 22 to be rotated and selectively positioned in any one of a plurality of positions as will be described.

In the preferred embodiment of the present invention, handle guide 22 includes an elongated center portion 32 that is generally configured as a section of a cylinder including arcuate cross-sectional portions. The center portion 32 extends between and is connected to the end portions of the guide, and defines a first opening or cutout 34 within which the associated one of control handles 14 is positionable when the handle guide 22 is in a first position. This first cutout 34 retains the control handle 14 against linear movement such as when the handle is in its neutral position. Retention of handle 14 is best illustrated in FIG. 4 in which the handle is shown within cutout 34. An operator would position guide 22 in this first position whenever movement of handle 14 from its neutral position is not desired or necessary. Thus, inadvertent movement of handle 14 is avoided.

The center portion 32 further defines a second opening or cutout designated 36 (see FIG. 3.) In the illustrated embodiment, cutout 36 is partially defined by an abutment portion 38 of handle guide 22 such that in a second position of the handle guide 22, the control handle 14 is operable by relatively limited linear movement along a portion of the elongated slot 18. As best shown in FIG. 5, when the guide 22 is in its second position, linear movement of control handle 14 in its first direction is limited by the abutment portion 38. In the embodiment shown, abutment portion 38 effectively locks control handle 14 out of its "float" position which normally allows selection of the "float" mode for the associated actuator. As noted, the "float" position is located at the furthest point of potential movement of the control handle 14 from its neutral position in the first direction. The operator would position guide 22 in this second position when usual two directional movement of handle 14 is required, but it is desired to prevent movement of the handle to its "float" position.

The handle guide 22 is further rotatably movable to a third position in which the control handle 14 is operable by generally linear movement along the full length of elongated slot 18. Operation of the control handle 14 within the full path length defined by slot 18 is best illustrated in FIG. 6 (it will be noted that the "float" position of handle 14 is generally designated "F" in this figure.)

In order to facilitate convenient selection of the various positions of handle guide 22, the present handle control arrangement preferably includes a detent mechanism for releasably maintaining the handle guide in any one of its selected positions. In the embodiment shown, the detent mechanism is generally designated 40, and is best illustrated in FIGS. 4, 7, 8 and 9. The detent mechanism 40 is preferably operatively associated with one end of guide 22, such as with thumb wheel 28 and mounting bracket 24 at the first end of handle guide 22.

As will be appreciated, various types of detent mechanisms can be provided for the present handle control arrangement. Bearing in mind that a straightforward and reliable construction for the detent mechanism is desirable, the mechanism preferably includes a plurality of projections on one of the guide 22 and the console cover 16, the projections being adapted to cooperate with the other of the guide and console cover for releasably maintaining the guide in its selected position. Suitable biasing means are preferably provided for maintaining at least one of the projections in cooperation with a suitable opening or the like which is adapted to receive the projections.

Accordingly, the illustrated detent mechanism 40 includes three projections 42 projecting from the thumb wheel 28, and a pair of members 44 on the adjacent mounting bracket 24 which define an opening or slot therebetween. The slot is adapted and configured to releasably receive a different one of the projections 42 when the handle guide 22 is in each of its first, second and third positions.

The detent mechanism 40 further preferably includes a biasing spring 48 which is operatively associated with the handle guide 22 as can be seen in FIGS. 4 and 7. The biasing spring 48 is captively held on the one of mounting pins 26 associated with the first end of said handle guide 22 between the mounting bracket 24 and a fastener 50. Notably, the handle guide 22 is mounted on the console cover 22 for limited movement axially of its rotational axis. In this manner, spring 48 is maintained in a compressed state and exerts force on the fastener 50, thereby urging the handle guide 22 and associated projections 42 into cooperation with the opening defined by members 44 on mounting bracket 24. Preferably, projections 42 and/or members 44 are provided with suitable chamfered and beveled surfaces to provide a cam-like cooperation between the projections 42 and the members 44. Thus, when it is desired to reposition handle guide 22, the thumb wheel 28 is rotated, causing one of the projections 42 to move from between members 44 as the guide shifts axially of its rotational axis in opposition the spring 48. The guide 22 is rotated to its desired position, whereupon another one of the projections 42 is received between members 44 and maintained therebetween by the biasing action of spring 48.

In order to further control the rotational movement of handle guide 22, suitable stops are preferably provided to limit its rotational movement. As illustrated, thumb wheel 28 also includes stop tabs 52 for limiting the rotational movement of the handle guide 22. The rotational movement of the guide 22 is limited by engagement of the stop tabs 52 with the mounting bracket 24. When the guide is in either its first "neutral lock" position (see FIGS. 4 and 8) or in its third "float" position (see FIGS. 6 and 9), engagement of one or the other of stop tabs 52 with bracket 24 prevents rotation of the guide past either one of those two extreme positions.

Thus, the present invention provides an arrangement for selectively controlling the movement of a control handle extending through a control console cover, and facilitates selective definition of a plurality of ranges of available movement of the control handle. Such an arrangement facilitates efficient and convenient operation of a material handling device by its operator.

While the present invention has been illustrated for use with the control console of a tractor cab, it will be recognized that the novel arrangement can be readily adapted to provide the necessary predetermined ranges of movement for control handles used in a variety of different control console installations. It will also be recognized that in some applications it may be desirable to provide the rotatable handle guide 22 with fewer or greater than the three selectable positions herein described.

From the foregoing, it will be appreciated that numerous variations and modifications may be effected without departing from the true spirit and scope of the novel concept of the present invention. It will be understood that no limitation with respect to the specific apparatus illustrated herein is intended or should be inferrred. It is, however, intended to cover by the appended claims all such modifications as fall within the scope of the claims.

What is claimed is:

1. A control arrangement for selectively defining the range of movement of a linearly moveable control handle which extends through a control console cover, comprising:

handle guide means mounted on and beneath said console cover for rotational movement about an axis generally parallel to the direction of linear movement of said control handle, said guide means including operating means projecting through said console cover for rotationally manipulating said guide means about said axis;

said guide means being configured such that in a first position of said guide means said handle is retained against linear movement in a neutral position within a first opening defined by said guide means, in a second position of said guide means said handle is operable through a range of limited linear movement within a second opening defined by said guide means, said second opening being larger than said first opening, and in a third position of said guide means said handle is operable through a range of relatively greater linear movement.

2. The handle movement control arrangement of claim 1, wherein said guide means includes opposite end portions adapted for rotational mounting of said guide means with respect to said console cover;

said guide means further including an elongated center portion extending between and connected with said end portions;

said elongated center portion defining said first opening within which said handle is adapted to be positioned when said guide means is in said first position for restraining movement of said handle from said neutral position;

said elongated center portion further defining said second opening adapted to define said range of limited linear movement of said handle when said guide means is in said second position.

3. The handle movement control arrangement of claim 2, including detent means operatively associated with said guide means and said console cover for releasably maintaining said guide means in any selected one of said positions.

4. A control arrangement for selectively defining the range of movement of a linearly moveable control handle which extends through a control console cover, comprising:

handle guide means mounted on said console cover for rotational movement about an axis generally parallel to the direction of linear movement of said control handle;

said guide means being configured such that in a first position of said guide means said handle is retained against linear movement in a neutral position, in a second position of said guide means said handle is operable through a range of limited linear movement, and in a third position of said guide means said handle is operable through a range of relatively greater linear movement;

said guide means including opposite end portions adapted for rotational mounting of said guide means with respect to said console cover, said guide means further including an elongated center portion extending between and connected with said end portions;

said elongated center portion defining a first opening within which said handle is adapted to be positioned when said guide means is in said first position for restraining movement of said handle from said neutral position;

said elongated center portion further defining a second opening adapted to define a range of limited linear movement of said handle when said guide means is in said second position; and detent means operatively associated with said guide means and said console cover for releasably maintaining said guide means in any selected one of said positions;

said detent means comprising a plurality of projections on one of said guide means and said console cover, said projections being adapted to cooperate with the other of said guide means and said console cover;

said detent means further including biasing means for maintaining at least one of said projections in cooperation with the other of said guide means and said console cover in each one of said positions of said guide means.

5. The handle movement control arrangement of claim 4, wherein:

said guide means is mounted on said console cover for limited movement of said guide means axially of its rotational axis in opposition to said biasing means to permit selective, releasable positioning of said guide means.

6. A control device for selectively controlling the range of linear movement of a control handle which extends through an elongated slot defined by a control console cover, comprising:

a control handle guide mounted on and beneath said console cover, including opposite end portions for rotatably mounting said guide on said console cover and for allowing limited rotational movement of said guide about an axis generally parallel to the direction of linear movement of said control handle, said handle guide including operating means projecting through said console cover for rotationally manipulating said handle guide about said axis between first, second, and third positions;

said handle guide including an elongated center portion extending between and connecting said end portions, said center portion defining a first opening within which said control handle is positionable in said first position of said guide to retain said control against linear movement in a neutral position, said center portion further defining a second opening larger than said first opening such that in said second position of said guide, said handle is operable by relatively limited linear movement along a portion of said elongated slot, said center portion including an abutment portion partially defining said second opening against which said handle is positionable to limit movement of said handle in one direction when said guide is in said second position, said guide being movable to said third position, said handle being operable by linear movement along the length of said elongated slot when said guide is in said third position.

7. A control device for selectively controlling the range of linear movement of a control handle which extends through an elongated slot defined by a control console cover, comprising:

a control handle guide mounted on and beneath said console cover, including opposite end portions for rotatably mounting said guide on said console cover and for allowing limited rotational movement of said guide about an axis generally parallel to the direction of linear movement of said control handle;

said handle guide including an elongated center portion extending between and connecting said end portions, said center portion defining a first opening within which said control handle is positionable in a first position of said guide to retain said control handle against linear movement in a neutral position, said center portion further defining a second opening such that in a second position of said guide, said handle is operable by relatively limited linear movement along a portion of said elongated slot, said center portion including an abutment portion partially defining said second opening against which said handle is positionable to limit movement of said handle in one direction when said guide is in said second position, said guide being movable to a third position, said handle being operable by linear movement along the length of said elongated slot when said guide is in said third position, said elongated center portion being generally configured as a section of a cylinder including arcuate cross-sectional portions.

8. A control device for selectively controlling the range of linear movement of a control handle which extends through an elongated slot defined by a control console cover, comprising:

a control handle guide mounted on and beneath said console cover, including opposite end portions for rotatably mounting said guide on said console cover and for allowing limited rotational movement of said guide about an axis generally parallel to the direction of linear movement of said control handle;

said handle guide including an elongated center portion extending between and connecting said end portions, said center portion defining a first opening within which said control handle is positionable in a first position of said guide to retain said control handle against linear movement in a neutral position, said center portion further defining a second opening such that in a second position of said guide, said handle is operable by relatively limited linear movement along a portion of said elongated slot, said center portion including an abutment portion partially defining said second opening against which said handle is positionable to limit movement of said handle in one direction when said guide is in said second position, said guide being movable to a third position, said handle being operable by linear movement along the length of said elongated slot when said guide is in said third position; and detent means operatively associated with one of said end portions of said guide and said console cover for releasably maintaining said guide in any selected one of said positions;

said detent means comprising three projections projecting from said one end portion, and means on said console cover defining an opening adapted to releasably receive a different one of said projections when said guide is in each of said first, said second and third positions;

said detent including biasing means operatively associated with said guide, said guide being mounted on said console cover for limited movement axially of its rotational axis in opposition to said biasing means so that said biasing means acts on said guide to urge said projections into cooperation with said opening to releasably maintain said guide in any one of said positions.

9. The controlling arrangement of claim 8, wherein said guide includes stop means for limiting the rotational movement of said guide.

* * * * *